United States Patent [19]

Franssen, deceased et al.

[11] 4,395,588

[45] Jul. 26, 1983

[54] MFB SYSTEM WITH A BY-PASS NETWORK

[75] Inventors: Nico V. Franssen, deceased, late of Knegsel, Netherlands; Friedrich J. de Haan, administrator, Dommelen, Netherlands; Adrianus J. M. Kaizer; Cornelis A. M. Wesche, both of Eindhoven, Netherlands

[73] Assignee: U.S. Philips Corporation, New York, N.Y.

[21] Appl. No.: 241,992

[22] Filed: Mar. 9, 1981

[30] Foreign Application Priority Data

Mar. 18, 1980 [NL] Netherlands ..... 8001592

[51] Int. Cl.[3] ..... H04R 9/06

[52] U.S. Cl. ..... 179/1 F

[58] Field of Search ..... 179/1 F; 330/75, 86, 330/97, 99, 110

[56] References Cited

U.S. PATENT DOCUMENTS

| | | | |
|---|---|---|---|
| 3,798,374 | 3/1974 | Meyers | 179/1 F |
| 3,889,060 | 6/1975 | Goto | 179/1F |
| 3,937,887 | 2/1976 | Miller | 179/1 F |
| 4,180,706 | 12/1979 | Bakgaard | 179/1 F |
| 4,276,443 | 6/1981 | Meyers | 179/1 F |
| 4,287,389 | 9/1981 | Gamble | 179/1 F |

*Primary Examiner*—G. Z. Rubinson
*Assistant Examiner*—L. C. Schroeder
*Attorney, Agent, or Firm*—Robert T. Mayer; Bernard Franzblau

[57] ABSTRACT

A device for driving an electroacoustic transducer (1) comprising a feedback amplifier and a pickup (2) whose output signal is a measure of the acoustic output signal of the transducer. A by-pass network (4) bypasses at least the transducer and the pickup and produces an output signal that for frequencies outside the operating range of the transducer is large and for frequencies in the operating range ($f_l$ to $f_h$) of the transducer is small relative to the pickup output signal. The sum of the output signals of the pickup and the by-pass network serves as a feedback signal. This widens the transducer frequency range and reduces distortion. The device may include a limiter (11) and a network (5) before the transducer. The network has a frequency response inverse to that of the signal path from the electroacoustic transducer to the pickup to provide an additional reduction in the distortion.

16 Claims, 3 Drawing Figures

MFB SYSTEM WITH A BY-PASS NETWORK

The invention relates to a device for converting an electric signal into an acoustic signal, and more particularly to an electrostatic conversion device that provides a high fidelity sound signal from an electric input signal.

U.S. Pat. 4,180,706 describes a device comprising an electroacoustic transducer, means for driving said electroacoustic transducer, a pickup for supplying an electric output signal which is a measure of the acoustic output signal of the transducer, a bypass network which electrically bypasses at least the transducer and pick-up, a combination unit for combining the output signals of the pick-up and the bypass network, and a feedback circuit for feeeding back the output signal of the combination unit as a negative feedback signal. The object of such a device is to achieve optimum fidelity between the sound signal radiated by the transducer and the electric input signal. In order to achieve this, a bypass network is provided which operates inside the operating frequency range of the transducer. However, such a device is apt to give rise to instabilities (accoustic feedback) which fully eliminates the effect of the optimum fidelity.

An object of the invention is to provide a device in which the degree of negative feedback can be increased substantially without the device becoming unstable so that very stringent requirements in respect of the fidelity of reproduction and the freedom from distortion can be met and the frequency range can be extended considerably.

The device in accordance with the invention is therefore characterized in that the by-pass network, which electrically bypasses at least the transducer and the pickup, and which is adapted to produce an output signal which for frequencies within the operating frequency range of the transducer is small and for at frequencies situated outside the operating frequency range of the transducer is large relative to the output signal of the pickup.

The invention is based on the recognition that instabilities are mainly caused by signals of frequencies outside the operating frequency range of the transducer, namely low-frequency instabilities as a result of signals with frequencies in the frequency range below the operating frequency range of the transducer or high-frequency instabilities as a result of signals with frequencies above the operating frequency range of the transducer, or as a result of both low-frequency and high-frequency signals. In these frequency ranges the output signal of the pickup is no longer suitable for use as the feedback signal because the pickup signal sometimes exhibits phase shifts of 180° so that positive feedback may occur instead of negative feedback.

Low-frequency instabilities arise because the transmission characteristic of the transducer pick-up combination exhibits a large phase shift for these frequencies so the instabilities occur when increasing the amount of negative feedback. Furthermore, the pick-up produces a very small amplitude, for DC even zero in some cases, so that only a minimal amount of feedback occurs.

High-frequency instabilities are caused by the fact that the sound-radiating diaphragm of a sound transducer starts to break up at these frequencies - the diaphragm surface no longer vibrates all over with the same phase - which results in substantial phase shifts and amplitude variations in the output signal of the pick-up so that positive feedback may occur instead of negative feedback.

The step in accordance with the invention now ensures that the device also remains stable in the range outside the operating frequency range of the transducer because in this range the negative feedback signal is mainly determined by the output of the by-pass network, which in this range has a substantially higher amplitude than the pickup signal and is not affected by said uncontrolled phase shifts. Within the operating range of the transducer the pickup signal is accurately related to the volume velocity of the transducer so that in this range the signal from the pickup may be used as a feedback signal.

Owing to the increased stability of the device it is now possible to apply stronger feedback within the device so that higher reproduction fidelity and reduced distortion can be achieved over a wider operating range of the transducer.

It is to be noted that German Offenlegungsschrift No. 2626652, U.S. Pat. No. 4,276,443 and British Pat. No. 1,534,842 all show devices having a by-pass network which bypasses the transducer and the pick-up as well. However, in all cases the by-pass network does not produce an output signal which can serve as a feedback signal in the low frequency region below, as well as in the high frequency region above, the operation frequency range of the transducer.

The by-pass network of the device in accordance with the invention may be characterized in that it comprises a band-stop filter having two cut-off frequencies that correspond to the limit frequencies of the operating frequency range of the transducer.

This step ensures that the device is stable for both low and high frequencies. Such a band-stop filter may for example be realized by the parallel arrangement of a low-pass and a high-pass filter.

The by-pass network may further be characterized in that a filter in said network has a filter characteristic of at least the second order.

As the difference between the amplitude of the transmission from the transducer to the pickup and the transmission amplitude of the by-pass network is a measure of the effective feedback in the device, a greater difference between the two amplitudes is obtained owing to the steeper roll-off of the higher order filters so that greater effective feedback is obtained in the operating range of the transducer, which may yield an additional reduction of the distortion.

A second embodiment of the device in accordance with the invention is characterized in that the transducer is preceded by a second network whose frequency response in the operating frequency range of the transducer at least substantially corresponds to the inverse of the frequency response of the signal path from the input of the transducer to the output of the pickup. This ensures that the effective feedback in the operating range of the transducer can be increased significantly, so that an additional reduction of the distortion can be obtained, the operating frequency range of the transducer can be extended, and the low frequency and the high frequency roll-off of the by-pass network can be shifted to the lower and the higher frequencies respectively.

A preferred embodiment of the device in accordance with the invention is characterized in that, in order to avoid clipping of the signals in the device, the device comprises a limiter with the limiting level of the limiter at least substantially corresponding to the level of the dynamic range of the device. If the device is overdriven by an excessive input signal without the presence of a limiter, this signal will be clipped by the device. This clipping action of the device cannot be corrected so that distortion increases. The introduction of a limiter prevents the occurrence of such a clipping action so that the high reproduction fidelity and freedom of distortion are maintained.

A further embodiment of the device in accordance with the invention is characterized in that the input of the limiter is coupled to an input terminal of the device for receiving an input signal. This step is based on the recognition that if the limiter were included at a different location in the device, for example in the negative feedback loop, this would reduce the negative feedback, which is particularly undesirable at maximum drive because this is the very situation in which the greatest distortion occurs. This step now ensures that a maximum drive full benefit can be derived from the maximum attainable negative feedback, which keeps the distortion in the device very small.

Another embodiment of the device in accordance with the invention is characterized in that the limiter is provided with an associated low-pass filter whose cut-off frequency is situated below the lower limit of the operating frequency range of the transducer. Furthermore, the input of the associated low-pass filter is connected to the input of the transducer and the output of the associated low-pass filter is connected to the control input of the limiter. As the frequency response of the input signal of the transducer is not entirely flat, the device can no longer be driven to the full extent at all frequencies owing to the presence of the limiter. This last step yields the advantage of a fequency-dependent limitation so that the device can be driven to the full extent for all frequencies.

The invention will now be described in greater detail with reference to the drawing. In the drawing.

Figure 1:
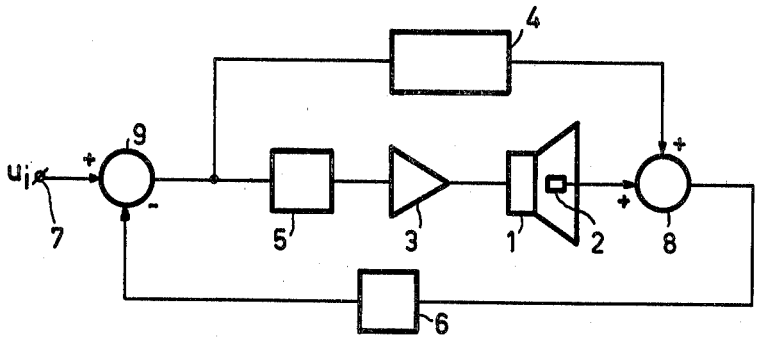
FIG. 1 shows a first device in accordance with the invention.

FIG. 1 shows a device in accordance with the invention comprising an electro-acoustic transducer 1, a pickup element whose output signal is a measure of the acoustic output signal of the transducer 1, an amplifier 3, a by-pass network 4, a second network 5, and a feedback network 6, for example in the form of an amplifier.

The input signal $u_i$ may be applied to the device via terminal 7. However, it is also possible to apply the input signal to another point in the circuit. The output signal of the network 4 and that of the pickup 2 are combined in a combination unit 8, for example in the form of an adder circuit and, via the feedback network 6, is supplied to a combination unit 9, for example in the form of a subtractor circuit.

The pickup 2 may be a displacement transducer, a velocity transducer or an acceleration transducer and may be connected rigidly to the voice coil (if the electroacoustic transducer has one) or the sound-radiating diaphragm of the electroacoustic transducer. Preferably, use is made of an acceleration pickup because then no additional correction networks for correcting the frequency response of a signal in the device are needed. The movement may alternatively be detected optically instead of mechanically.

The output signal of the combination unit 9 is applied to the by-pass network 4 and to the transducer 1. The network 5 need not necessarily be included in the device. The network 5 has a frequency response which is the inverse of the overall frequency response of the signal path from the input of the transducer 1 to the output of the pickup 2. This ensures that the signal path from the input of the network 5 to the output of the pickup 2 has a substantially flat frequency response curve. This frequency response curve is designated 10 in FIG. 2.

Figure 2:
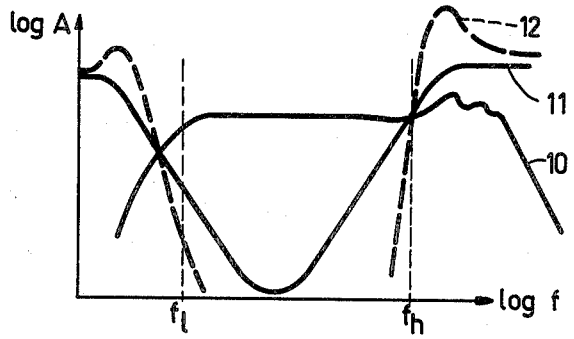
FIG. 2 shows two possible frequency response curves for the cross-over network of FIG. 1.

The by-pass network 4 should have a frequency response such that its output signal at frequencies situated in the operating range of the transducer, represented by the frequency range between the frequencies $f_l$ and $f_h$ in FIG. 2, is small relative to the output signal of the pickup 2, and that the output signal of the by-pass network 4 at frequencies situated above and below the operating range of the transducer is large relative to the output signal of the pickup 2.

If both low-frequency and high-frequency instabilities are anticipated, the by-pass network should comprise a band-stop filter whose cut-off frequencies correspond to the limit frequencies of the operating frequency range of the transducer.

An example of such a frequency response curve for the by-pass network 4 is designated 11 in FIG. 2, the amplitude and the frequency being plotted logarithmically along the vertical and horizontal axes respectively.

This characteristic may for example be obtained by the parallel arrangement of a low-pass filter and a high-pass filter, whose respective cut-off frequencies at least substantially correspond to the lower limit $f_l$ and the upper limit $f_h$ respectively of the operating frequency range of the transducer.

The effective feedback for the transducer in its operating range is determined by the difference in level between the curves 10 and 11 in FIG. 2. By selecting a characteristic for the by-pass network 4 which rolls off more steeply in the operating frequency range of the transducer, the said difference can be increased, so that a more effective feedback can be realized. An example of such a characteristic with a steeper roll-off for the by-pass network 4 is represented by the dashed line 12 in FIG. 2. Such a characteristic can for example be obtained by using filters in the by-pass network having a higher order characteristic, for example a second order and a sufficiently high quality factor. FIG. 2 shows that in the operating range of the transducer the difference in level between the characteristics 10 and 12 is greater than the difference between the characteristics 10 and 11.

In the operating frequency range of the transducer the transmission of the circuit 5-3-1-2 has a flat phase- and frequency characteristic. The output signal of the pickup 2 is then suitable for use as the feedback signal. As the frequency response of the transducer 1 is levelled by the network 5, it is not necessary to effect such levelling by feedback. The feedback need only provide an effective suppression of the distortion components, and this fact, in comparison with the device without the network 5 results in a substantially smaller distortion and a larger operation frequency range for the transducer. Outside the operation range of the transducer the output signal of the pickup 2 is not suitable for use as the feedback signal. This is because for frequencies lower than $f_l$ the output signal of the pickup 2 drops off sharply (6 db/octave or more) towards lower frequencies and thus has a very small amplitude and even contains no d.c. component. For frequencies higher than $f_h$ the sound-radiating diaphragm of the sound transducer starts to break up, so that substantial phase shifts occur in the pickup signal.

The feedback loop including elements 5-3-1-2 is therefore unstable in both ranges. By employing the output signal of the by-pass network 4 as the feedback signal for these ranges, the device is also stable far beyond the operating range of the transducer. The result is an extended operating range of the device and the possibility of stronger negative feedback, which results in even smaller distortion, especially at the low frequencies.

In the foregoing it has been assumed that the input signal of the by-pass network 4 corresponds to the input signal of the network 5. However, this is not necessarily so.

The input of the by-pass network 4 may equally well be connected to the output of the network 5 or the output of the amplifier 3. In either case the frequency response of the by-pass network 4 should be adapted accordingly and should correspond to that which would be given by a series combination of filters, one having the original characteristic, as is represented by 11 or 12 in FIG. 2, and one with a characteristic which is the inverse of the transmission characteristic of the network 5. In the case that where the by-pass network 4 is connected to the output of the amplifier 3, the by-pass network should moreover by corrected to take into account the gain of amplifier 3.

Figure 3:
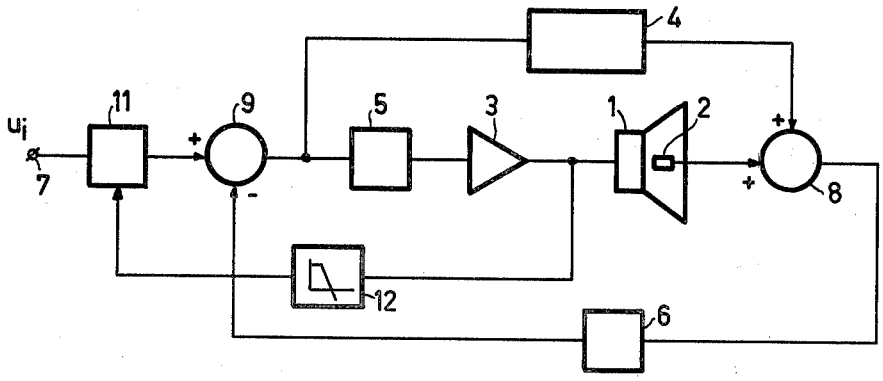
FIG. 3 shows a second device in accordance with the invention equipped with a limiter.

FIG. 3 shows an alternative device in accordance with the invention. Elements in FIGS. 1 and 3 having the same reference numerals are identical. The device is equipped with a limiter 11, the input of the limiter being preferably connected directly to the input terminal 7 of the device. The device may also be provided with a low-pass filter 12 having a sufficiently low cut-off frequency, suitably of the order of magnitude of 1 Hz, which is sufficiently low that it is situated below the lower limit of the frequency range of the transducer. The input signal of the transducer 1 is applied to the filter and the output signal of the low-pass filter 12 is applied to a control input of the limiter 11 that determines the limiting level.

The reason for the introduction of the limiter 11 is that otherwise, when the device is overdriven by an excessive input signal $u_i$, this signal will be clipped by the device. This clipping cannot be corrected by the device and results in a high degree of distortion in the signal for the transducer. By the introduction of the limiter 11 into the device, the limiting level, at which the limiter becomes operative, corresponding to the dynamic range of the device, overdriving of the device and thus the occurrence of substantial distortion in the device can be prevented.

Moreover, including the limiter 11 before the combination unit 9 in the device, instead of, for example, in the negative feedback loop, has additional advantages. If the limiter were included in the feedback loop the negative feedback would be reduced. This would be especially undesirable at maximum drive. At the maximum drive the highest degree of distortion occurs. As a result of the reduction of the negative feedback said distortion could not be suppressed in an optimum manner.

By including the limiter between the input terminal 7 and the combination unit 9, the maximum negative feedback can be maintained so that at the maximum drive full benefit can be derived from said negative feedback, which minimizes the distortion in the device.

As the frequency response of the input signal path to the transducer 1 is not flat, the device could, in the absence of the control by the limiter 11, no longer be driven to the full extent at all frequencies.

By applying the input signal of the transducer to the control input of the limiter 11 via the low-pass filter 12, frequency-dependent limiting is obtained so that the device can be driven to the full extent for all frequencies.

Finally, it is to be noted that the invention is not limited to the embodiments shown. The invention may also be applied to devices in which the elements are arranged in a different sequence. For example, the feedback network 6 may equally well be included in the circuit between the combination unit 9 and the transducer 1. By then deriving the input signal for the by-pass network 4 from the output of the amplifier 3 the following advantages are obtained.

First of all the gain of the device and its stability will be independent of variations in the gain factors of the amplifier units 3 and/or 6.

Secondly, the two amplifer units 3 and 6 may be combined and be constituted by a power amplifier of arbitrary type.

Furthermore, it should be note that the invention may also be used in devices in which motion detection is effected in a manner other than those described in the foregoing.

What is claimed is:

1. A device for converting an electric signal into an acoustic signal comprising, an electroacoustic transducer, means for driving said electroacoustic transducer, a pick-up element for supplying an electric output signal which is a measure of the acoustic output signal of the transducer, a by-pass network which electrically bypasses at least the transducer and the pick-up element, a combination unit for combining the output signal of the pickup element and the output signal of the by-pass network, and a feedback circuit for feeding back to the transducer driving means the output signal of the combination unit as a negative feedback signal, characterized in that the by-pass network is adapted to produce an output signal which for frequencies within the operating frequency range of the transducer is small and for frequencies above and below the operating frequency range of the transducer is large relative to the output signal of the pickup element.

2. A device as claimed in claim 1 wherein the by-pass network comprises a band-stop filter having two cut-off frequencies correspond to the limit frequencies of the operating frequency that range of the transducer.

3. A device as claimed in claim 2, wherein the band-stop filter comprises a parallel arrangement of a low-pass filter an a high-pass filter.

4. A device as claimed in claim 3 wherein a filter in the by-pass network has a filter characteristic of at least the second order.

5. A device as claimed in claims 1, 2, 3 or 4 further comprising a second network connected in a signal path between an input terminal and the transducer, said second network having a frequency response in the operating frequency range of the transducer that at least substantially corresponds to the inverse of the frequency response of the signal path from the input of the transducer to the output of the pickup element.

6. A device as claimed in claims 1, 2, 3 or 4 further comprising a limiter coupled in circuit so as to prevent clipping of the signal in the device, the limiting level of the limiter at least substantially corresponding to the level of the dynamic range of the device.

7. A device as claimed in claim 6, characterized in that the input of the limiter is coupled to an input terminal of the device for receiving an input signal.

8. A device as claimed in claim 6 further comprising a low-pass filter having a cut-off frequency below the lower limit frequency of the operating frequency range of the transducer, and means connecting an input of the low-pass filter to the input of the transducer and an output of the low-pass filter to a control input of the limiter.

9. A device as claimed in claim 5 further comprising a limiter connected in said signal path between the input terminal and an input of the transducer so as to prevent signal clipping, and wherein the limiting level of the limiter corresponds to the level of the dynamic range of the device.

10. A device as claimed in claim 9 further comprising a low-pass filter having a cut-off frequency below the lower frequency limit of the transducer operating frequency range, and means coupling the low pass filter between the transducer input and a control input of the limiter so as to provide a frequency-dependent limiting action by the limiter.

11. A sound reproduction system comprising a signal input terminal, an electroacoustic transducer, a signal path including a first combination unit and an amplifier connected in cascade between the input terminal and an input of the transducer, a pick-up device coupled to the transducer, a second combination unit having a first input coupled to an output of the pick-up device, a by-pass network having an output coupled to a second input of the second combination unit and coupled in circuit so as to electrically bypass at least the transducer and the pick-up device, said by-pass network deriving an output signal which for frequencies within the transducer frequency range is small and for frequencies above and below said transducer frequency range is large relative to the pick-up device output signal, and a negative feedback network coupling an output of the second combination unit to an input of the first combination unit.

12. A sound system as claimed in claim 11 wherein the by-pass network comprises a band-stop filter having first and second cut-off frequencies related respectively to the upper and lower limit frequencies of the transducer operating frequency range.

13. A sound system as claimed in claim 11 further comprising a second network connected in cascade in said signal path between an output of the first combination unit and the transducer input, said second network having a frequency response characteristic that is substantially inverse to the overall frequency response characteristic of a signal path from the transducer input to the pickup device output, at least witin the transducer operating frequency range.

14. A sound system as claimed in claim 13 wherein said by-pass network is coupled between the output of the first combination unit and said second input of the second combination unit.

15. a sound system as claimed in claims 11, 12 or 13 wherein said signal path further comprises a signal limiter connected in cascade between the signal input terminal and a second input of the first combination unit, the limiting level of said limiter corresponding substantially to the level of the dynamic range of the system.

16. A sound system as claimed in claim 15 further comprising a low-pass filter coupled between the transducer input and a control input of the limiter, said filter having a cut-off frequency below the lower frequency limit of the transducer operating frequency range.

* * * * *

UNITED STATES PATENT AND TRADEMARK OFFICE

CERTIFICATE OF CORRECTION

PATENT NO. : 4,395,588
DATED : July 26, 1983
INVENTOR(S) : NICO V. FRANSSEN (DECEASED) ET AL It is certified that error appears in the above—identified patent and that said Letters Patent is hereby corrected as shown below:

In the Claims:

Claim 2,line 3, after "frequencies" insert --that--;

Claim 2,line 4, after "frequency" delete "that";

Claim 3, line 3, "an" should be --and--.

Signed and Sealed this

First Day of November 1983

[SEAL]

*Attest:*

GERALD J. MOSSINGHOFF

*Attesting Officer*

*Commissioner of Patents and Trademarks*